US008047242B2

(12) United States Patent
Wall et al.

(10) Patent No.: US 8,047,242 B2
(45) Date of Patent: Nov. 1, 2011

(54) POWER TOOL WITH SPINDLE LOCK

(75) Inventors: Daniel Paxton Wall, Medina, TN (US); Craig A. Carroll, Milan, TN (US)

(73) Assignee: Black & Decker Inc., Newark, DE (US)

( * ) Notice: Subject to any disclaimer, the term of this patent is extended or adjusted under 35 U.S.C. 154(b) by 352 days.

(21) Appl. No.: 12/326,170

(22) Filed: Dec. 2, 2008

(65) Prior Publication Data

US 2009/0145259 A1 Jun. 11, 2009

Related U.S. Application Data

(60) Provisional application No. 61/005,924, filed on Dec. 7, 2007.

(51) Int. Cl.
*B27C 5/00* (2006.01)

(52) U.S. Cl. ..... 144/371; 408/710; 409/182; 279/148; 279/150; 144/136.95

(58) Field of Classification Search ..... 144/136.95, 144/134.1, 371; 409/182, 218, 180; 408/710; 279/148, 150
See application file for complete search history.

(56) References Cited

U.S. PATENT DOCUMENTS

| | | | | |
|---|---|---|---|---|
| 3,872,951 | A * | 3/1975 | Hastings, Jr. | 188/69 |
| 3,899,852 | A | 8/1975 | Batson | |
| 4,324,512 | A * | 4/1982 | Siroky | 408/240 |
| 4,489,525 | A | 12/1984 | Heck | |
| 5,022,188 | A | 6/1991 | Borst | |
| 5,191,968 | A * | 3/1993 | McCurry | 200/43.11 |
| 5,944,327 | A * | 8/1999 | Kanaan | 279/51 |
| 6,056,298 | A * | 5/2000 | Williams | 279/150 |
| 6,488,451 | B1 * | 12/2002 | Hartman | 408/124 |
| 7,108,464 | B2 * | 9/2006 | Cooper et al. | 409/182 |
| 7,128,641 | B1 | 10/2006 | Lin | |
| 7,303,364 | B2 * | 12/2007 | Cooper et al. | 409/182 |

FOREIGN PATENT DOCUMENTS

| | | | |
|---|---|---|---|
| DE | 28 16 398 | A1 | 10/1979 |
| DE | 30 01 907 | A1 | 7/1981 |
| EP | 0 235 598 | A | 9/1987 |
| WO | WO 99/50021 | A | 10/1999 |
| WO | WO 2005/016594 | A | 2/2005 |

OTHER PUBLICATIONS

Radu David, European Search Report mailed Apr. 1, 2009 in reference to European Patent Appln. No. 08170798—The Hague.

* cited by examiner

*Primary Examiner* — Shelley Self
(74) *Attorney, Agent, or Firm* — Harness, Dickey & Pierce, P.L.C.

(57) ABSTRACT

A power tool includes a spindle assembly supported for rotation about an axis. The spindle assembly includes a plurality of engagement members, and at least two of the engagement members are disposed in spaced relationship less than one hundred eighty degrees from each other with respect to the axis of the spindle assembly. The power tool also includes a spindle lock assembly that selectively engages at least one of the plurality of engagement members to lock the spindle assembly against rotation about the axis.

15 Claims, 5 Drawing Sheets

POWER TOOL WITH SPINDLE LOCK

CROSS REFERENCE TO RELATED APPLICATION

This application claims the benefit of U.S. Provisional Application No. 61/005,924, filed on Dec. 7, 2007, the disclosure of which is incorporated herein by reference in its entirety.

FIELD

The present disclosure relates to a power tool and, more particularly, relates to a power tool with a spindle lock.

BACKGROUND

The statements in this section merely provide background information related to the present disclosure and may not constitute prior art.

Many power tools include a spindle to which a tool can be coupled. For instance, many routers include a spindle that removably couples to a collet nut for coupling a routing bit to the spindle. A motor drivingly rotates the spindle and the attached routing bit. Typically, the collet nut is threaded on the spindle, and in order to couple and decouple the routing bit, the collet nut is rotated relative to the spindle. Thus, many routers include a spindle lock assembly for locking the spindle against rotation such that the collet nut can be rotated relative to the spindle.

For instance, the spindle lock assembly typically includes a button that is attached to a pin. The button is biased in a radially outward direction. In order to lock the spindle, the button is pushed against the biasing force, and the pin enters a corresponding hole in the spindle.

However, use of conventional spindle lock assemblies can be somewhat awkward. More specifically, the spindle only includes one hole in the spindle for the pin to enter to lock the spindle. As such, the spindle may need to be rotated substantially about the spindle axis before the pin aligns with and enters the hole. Some spindles may include two holes spaced one hundred and eighty degrees apart; however, even in this configuration, the spindle may need to be rotated substantially before the pin and one of the holes align.

Furthermore, a wrench or other tool is typically required to rotate the collet nut about this spindle axis relative to the spindle, and this process can be cumbersome and time consuming. In some cases (e.g., where surrounding space is limited), the user is only able to rotate the wrench within a limited angular zone about the spindle axis, and a single rotation of the wrench through this limited angular zone is not sufficient to fully engage or disengage the collet nut. More specifically, the user locks the spindle, couples the wrench to the collet nut, and rotates the wrench through the limited angular zone. If the collet nut still needs to be rotated, the user keeps the spindle locked, detaches the wrench from the collet nut and advances the wrench, and then re-couples the wrench to the collet nut before rotating the wrench again through the limited angular zone. This process is repeated until the collet nut is fully engaged or disengaged. Accordingly, this process can be inconvenient and time consuming.

Moreover, some conventional spindle lock assemblies include a button that is painful to depress. For instance, the button may be relatively small and the biasing force required to depress the button can be substantial, thereby causing painful pressure on the user's finger. In addition, in some cases, the user's skin can enter space between the button and the surrounding surfaces of the housing and become jammed or pinched therebetween.

SUMMARY

A power tool is disclosed that includes a spindle assembly supported for rotation about an axis. The spindle assembly includes a plurality of engagement members. At least two of the engagement members are disposed in spaced relationship less than one hundred eighty degrees from each other with respect to the axis of the spindle assembly. The power tool also includes a spindle lock assembly that selectively engages at least one of the plurality of engagement members to lock the spindle assembly against rotation about the axis.

In another aspect, a router is disclosed that includes a housing and a spindle assembly at least partially housed by the housing. The spindle assembly is supported for rotation about an axis, and the spindle assembly includes a plurality of detents each extending radially inward toward the axis. At least two detents are disposed in spaced relationship less than 180 degrees, and preferably less than 90 degrees, from each other with respect to the axis of the spindle assembly. The router also includes a spindle lock assembly including a button member, a mount, and a biasing member that biases the button member away from the spindle assembly. The button member includes a cap with an outer surface and pin. The mount is coupled to the housing and includes an outer surface that is concavely contoured generally toward the axis. The button member is supported for movement relative to the mount toward the spindle assembly to cause the pin to selectively engage at least one of the plurality of detents to lock the spindle assembly against rotation about the axis. The outer surface of the cap is surrounded by the outer surface of the mount. Also, the outer surface of the mount is disposed at least at a first minimum radial distance from the axis and, at the maximum displacement of the cap toward the axis, a radial distance from the axis to the outer surface of the button member is at least approximately equal to the first minimum radial distance.

In still another aspect, a method of rotating a collet nut relative to a spindle assembly of a router is disclosed. The method includes locking the spindle assembly against rotation about an axis with a spindle lock assembly. The spindle assembly includes a plurality of engagement members, and at least two engagement members are disposed in spaced relationship less than one hundred eighty degrees from each other with respect to the axis. Locking the spindle assembly includes selectively engaging at least one of the plurality of engagement members to lock the spindle assembly against rotation about the axis. The method also includes operatively coupling a removal tool to the collet nut. Furthermore, the method includes rotating the removal tool within a predetermined zone of rotation less than one hundred eighty degrees about the axis in a first direction to rotate the collet nut with respect to the spindle assembly. Additionally, the method includes releasing engagement between the spindle lock assembly and the spindle assembly. The method also includes rotating the removal tool, the collet nut, and the spindle assembly within the predetermined zone of rotation about the axis in a direction opposite to the first direction. Moreover, the method includes re-locking the spindle assembly against rotation about the axis with the spindle lock assembly by engaging the spindle lock assembly with another of the engagement members and rotating the removal tool within the predetermined zone of rotation about the axis in the first direction to further rotate the collet nut with respect to the spindle assembly.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
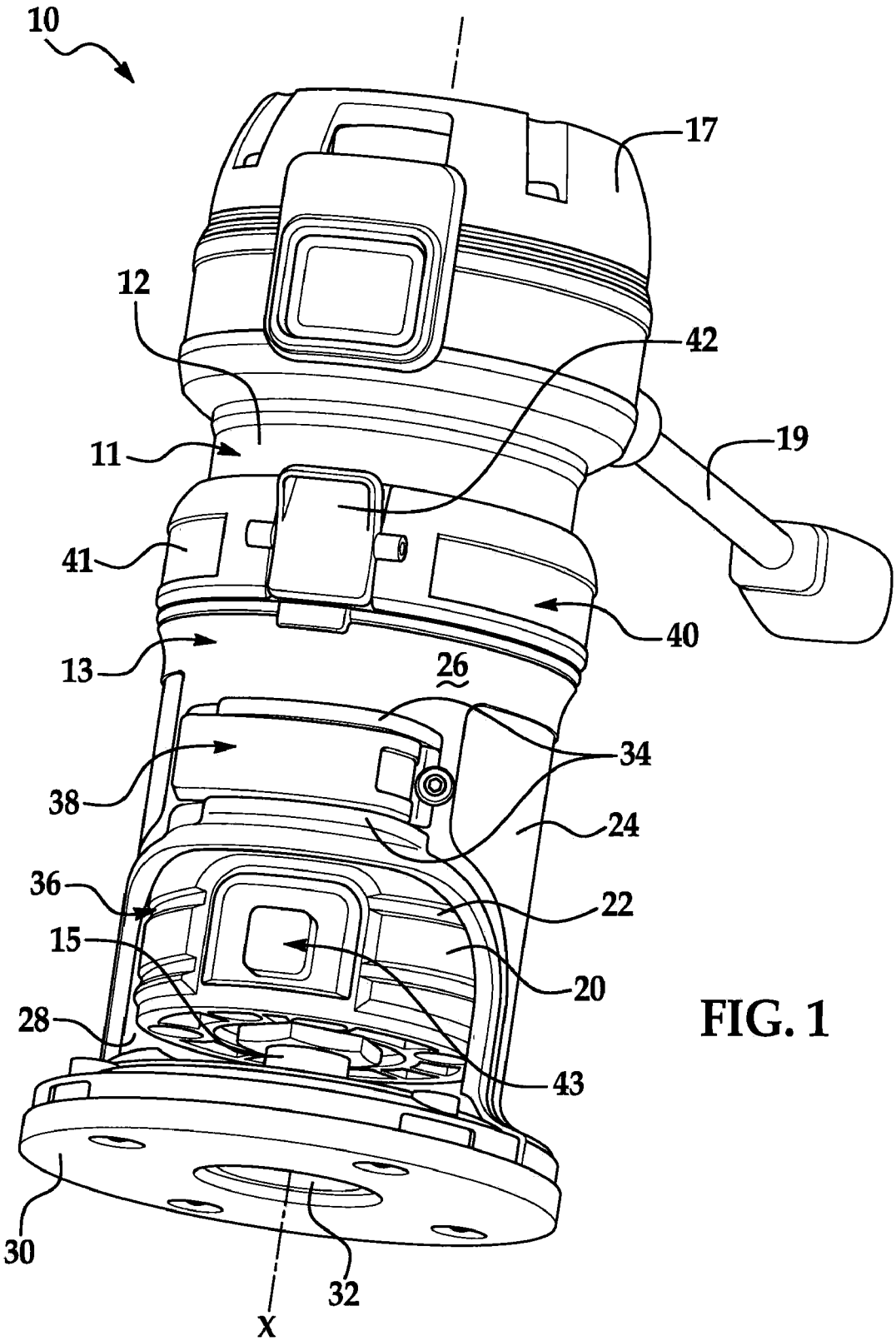
FIG. 1 is perspective view of a power tool with a spindle lock assembly according to the present disclosure.

The following description is merely exemplary in nature and is not intended to limit the present disclosure, application, or uses. It should be understood that throughout the drawings, corresponding reference numerals indicate like or corresponding parts and features.

Referring initially to FIG. 1, a power tool 10 is illustrated. In the embodiment shown, the power tool 10 is a router; however, the power tool 10 could be of any suitable type without departing from the scope of the present disclosure. It will also be appreciated that certain components (e.g., handles, etc.) of the power tool 10 are not shown for purposes of clarity.

As shown, the power tool 10 generally includes a motor assembly 11 and a base assembly 13. The motor assembly 11 generally includes a motor housing 12, which is cylindrical in shape. The motor housing 12 encloses and supports a motor (not shown), which can be of any suitable type. A spindle assembly 15 extends out of the motor housing 12, and a tool (e.g., a routing bit, not shown) can be removably attached to the spindle assembly 15. The motor assembly 11 also includes an electronics housing 17 mounted atop the motor housing 12 on an end opposite the spindle assembly 15. The electronics housing 17 encloses and supports necessary electronics equipment (not shown), control switches, buttons, displays, and other suitable components for operation of the power tool 10. A power cord 19 extends out of the electronics housing 17 and provides power to the power tool 10. It will be appreciated that the power tool 10 could be a cordless power tool 10 without departing from the scope of the present disclosure.

In the embodiment shown, the motor housing 12 is cylindrical and defines an outer surface 20. The outer surface 20 includes a thread 22. The thread 22 allows the motor assembly 11 to adjust in height relative to the base assembly 13 as will be discussed.

Furthermore, in the embodiment shown, the base assembly 13 includes a cylindrical wall 24 defining an outer surface 26, an inner surface 28, and a longitudinal axis X. In the embodiment shown, the base assembly 13, the motor assembly 11, and the spindle assembly 15 each share the same axis X.

In the embodiment shown, the base assembly 13 also includes a support 30 coupled to a lower end of the cylindrical wall 24. The support 30 is flat and disc-shaped. In one embodiment, the support 30 is made of a transparent material. The power tool 10 can be supported on a workpiece (not shown) via the support 30. The support 30 includes a central aperture 32 through which the spindle assembly 15 and/or a tool (e.g., a router bit) extend.

The cylindrical wall 24 includes a plurality of flanges 34 that extend outwardly and horizontally in a direction transverse to the axis X. In the embodiment shown, there are two flanges 34 disposed in spaced relationship to each other.

The cylindrical wall 24 defines a cavity 36 that is sized to receive the motor assembly 11 therein. The power tool 10 further includes a clamp assembly 38, which selectively provides a retention force to removably couple the motor assembly 11 to the base assembly 13. More specifically, the clamp assembly 38 can be in a closed position to retain the motor assembly 11 in the cavity 36, or the clamp assembly 38 can be opened to allow the motor assembly 11 to move relative to the base assembly 13.

The power tool 10 also includes a height adjusting mechanism 40. In the embodiment shown, the height adjusting mechanism 40 includes a dial 41 provided near a top end of the base assembly 13 so as to encircle the motor assembly 11. The dial 41 is releasably fixed to the top end of the base assembly 13 via a release member 42, and is internally threaded so as to threadably engage with the thread 22 provided on the outer surface 20 of the motor assembly 11. Thus, assuming the clamp assembly 38 is in the open position, rotation of the motor assembly 11 relative to the base assembly 13 threadably advances the motor assembly 11 in either the downward or upward direction parallel to the axis X.

Also, the release member 42 can be biased such that the release member 42 disengages from the base assembly 13. Accordingly, the motor assembly 11 can move out of the base assembly 13, leaving the dial 41 threadably coupled to the motor assembly 11.

In the embodiment shown, the base assembly 13 is a fixed base, meaning that the base assembly 13 is rigid and the height adjusting mechanism 40 is used to adjust the height of motor assembly 11, and hence the router bit, relative to the workpiece. However, it will be appreciated that the base assembly 13 could be a plunge base assembly 13 that is collapsible to actuate the motor assembly 11 toward and away from the workpiece without departing from the scope of the present disclosure.

Furthermore, the power tool 10 includes a spindle lock assembly 43 that selectively locks the spindle assembly 15 against rotation about the axis X. More specifically, the spindle lock assembly 43 can selectively lock the spindle assembly 15 against rotation to attach and/or remove a tool (e.g., a routing bit) to/from the spindle assembly 15.

Figure 2:
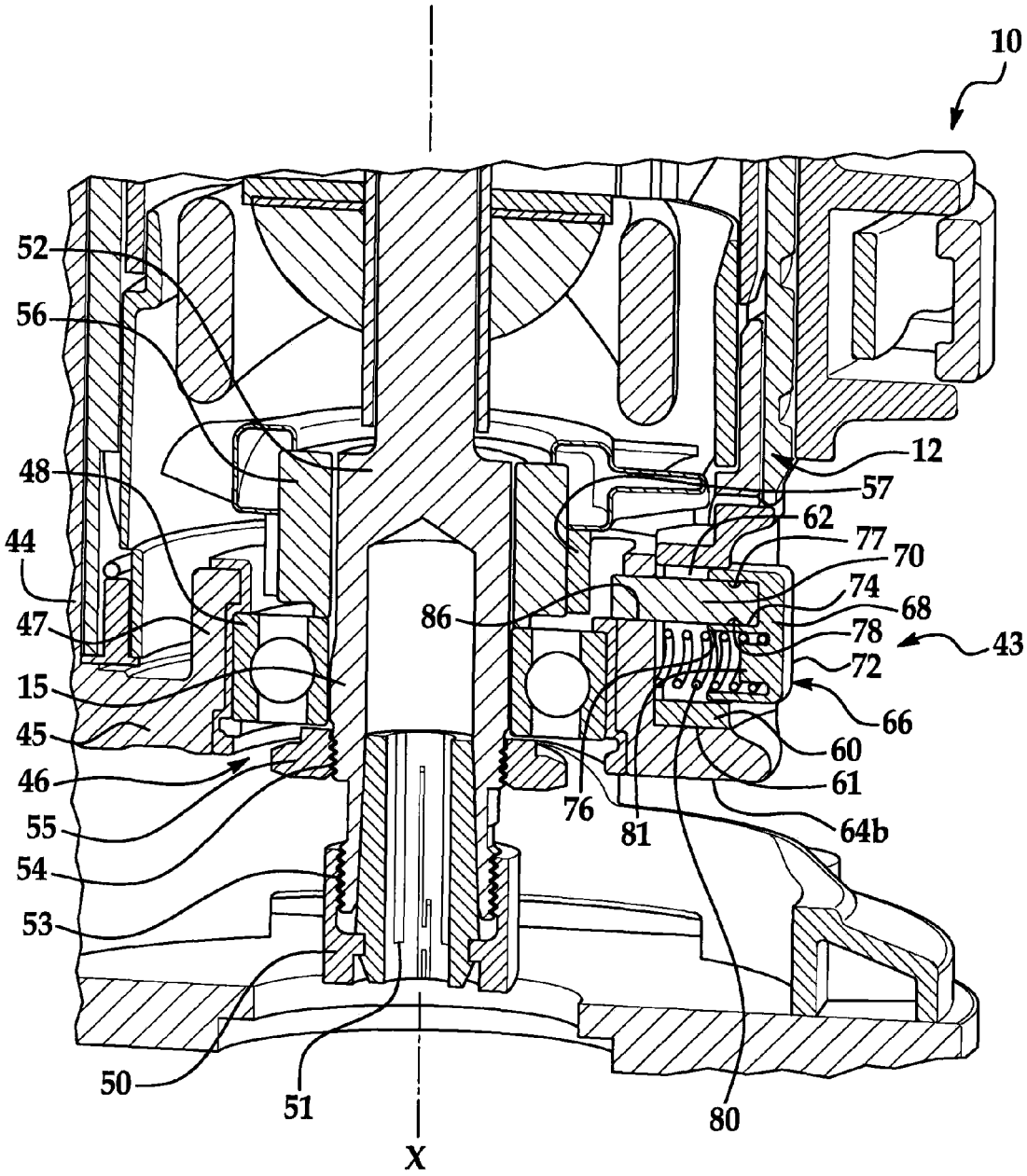
FIG. 2 is a perspective, sectional view of the power tool of FIG. 1.

Referring now to FIGS. 2-5, the spindle lock assembly 43 and other components of the power tool 10 will be described in greater detail. As shown in FIG. 2, the motor housing 12 includes a cylindrical outer wall 44 and a bottom wall 45 fixed to the bottom end of the outer wall 44. The bottom wall 45 defines a central aperture 46 through which the spindle assembly 15 extends out of the motor housing 12. Also, the motor housing 12 includes an inner wall 47, which extends parallel to the axis from the bottom wall 45 adjacent the center aperture 46. As such, the inner wall 47 is substantially concentric and spaced at a distance from the outer wall 44.

Furthermore, as shown in FIG. 2, the spindle assembly 15 is supported for rotation about the axis X. In the embodiment shown, the power tool 10 includes a bearing 48 that rotatably couples the spindle assembly 15 to the inner wall 47 of the motor housing 12. It will be appreciated that the bearing 48 could be of any suitable type. The motor of the motor assembly 11 drives the spindle assembly 15 for rotation about the axis X.

The spindle assembly 15 removably couples to a collet nut 50 (FIG. 2). In the embodiment shown, the spindle assembly 15 is threaded on a lower portion thereof, and the collet nut 50 is also threaded so as to removably and threadably engage with the spindle assembly 15. The collet nut 50 allows a tool (e.g., a routing bit) to be coupled to the spindle assembly 15. More specifically, the tool is positioned in a cavity 51 of the spindle assembly 15, and the collet nut 50 is threadably advanced on to the spindle assembly 15 to thereby retain the tool on the spindle assembly 15. To remove the tool, the collet nut 50 is threadably advanced off of the spindle assembly 15. It will be appreciated that the collet nut 50 could be of any known type.

Figure 5:
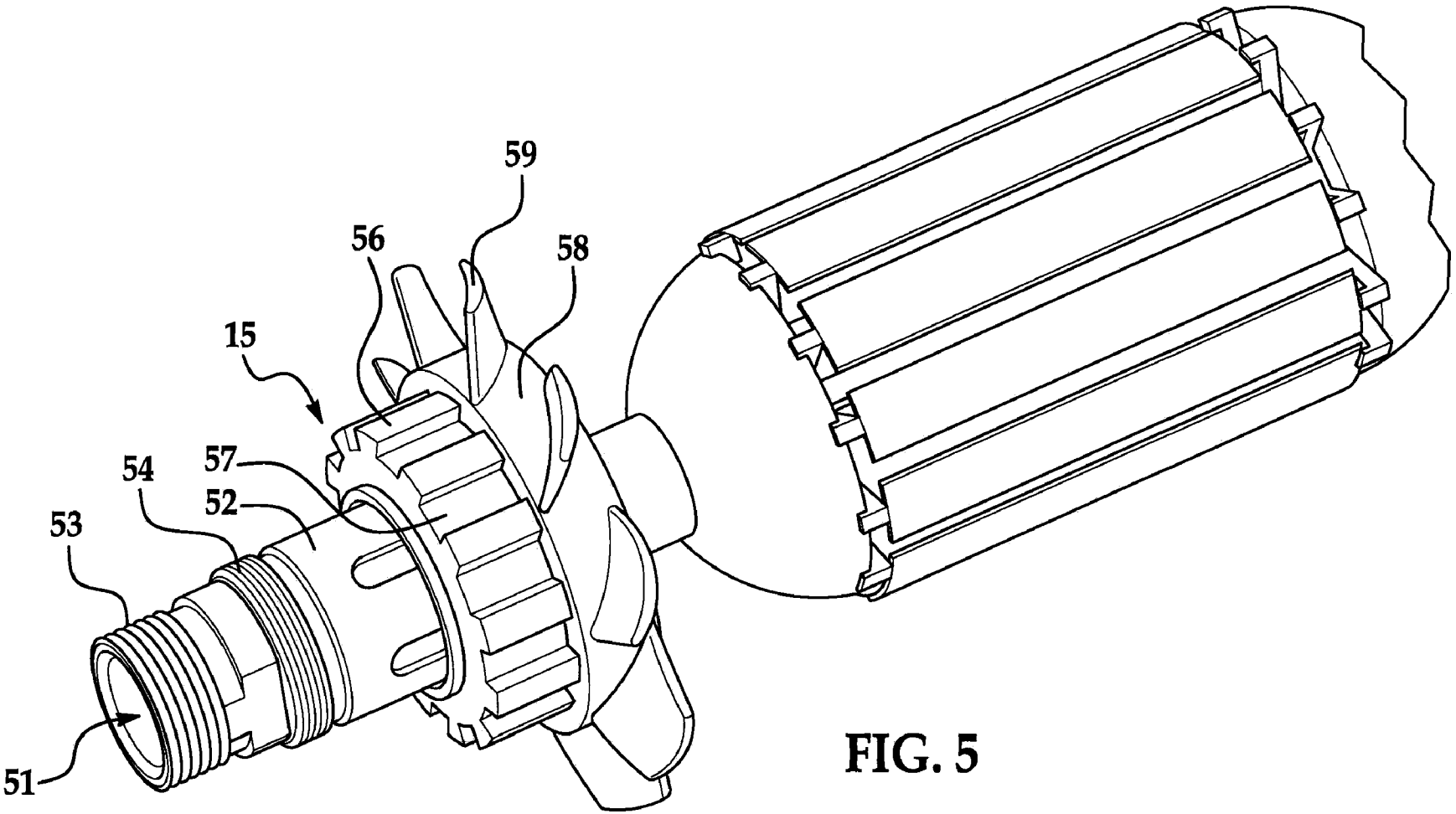
FIG. 5 is a perspective view of the spindle assembly of the power tool of FIG. 1.

More specifically, as shown in FIG. 5, the spindle assembly 15 includes a shaft 52. The shaft 52 is open at one end to define the cavity 51 and includes a first thread 53 for threadably coupling to the collet nut 50 (FIG. 2). The shaft 52 further includes a second thread 54 (FIG. 5) for threadably coupling to a retainer ring 55 (FIG. 2).

A ring 56 is fixedly coupled for rotation with the shaft 52 and encircles the shaft 52 above the second thread 54 (FIGS. 2 and 5). In one embodiment, the ring 56 is frictionally fit on the shaft 52 with a press machine. In another embodiment, the ring 56 is integrally attached to the shaft 52 such that the ring 56 and the shaft 52 are monolithic.

Also, the spindle assembly 15 includes a fan member 58 (FIG. 5) that encircles the shaft 52 above the ring 56. The fan member 58 includes a plurality of blades 59 for circulating air to the motor assembly 11 and adjacent the workpiece (not shown). In some embodiments, the fan member 58 also encircles the ring 56 and is fixed for rotation with the ring 56. For instance, in some embodiments, the fan member 58 includes a resilient flange (not shown) that is resiliently received within a groove (not shown) of the ring 56 such that the fan member 58 is fixed to the ring 56. In other embodiments, the fan member 58 and the ring 56 are integrally attached so as to be monolithic.

Figure 3:
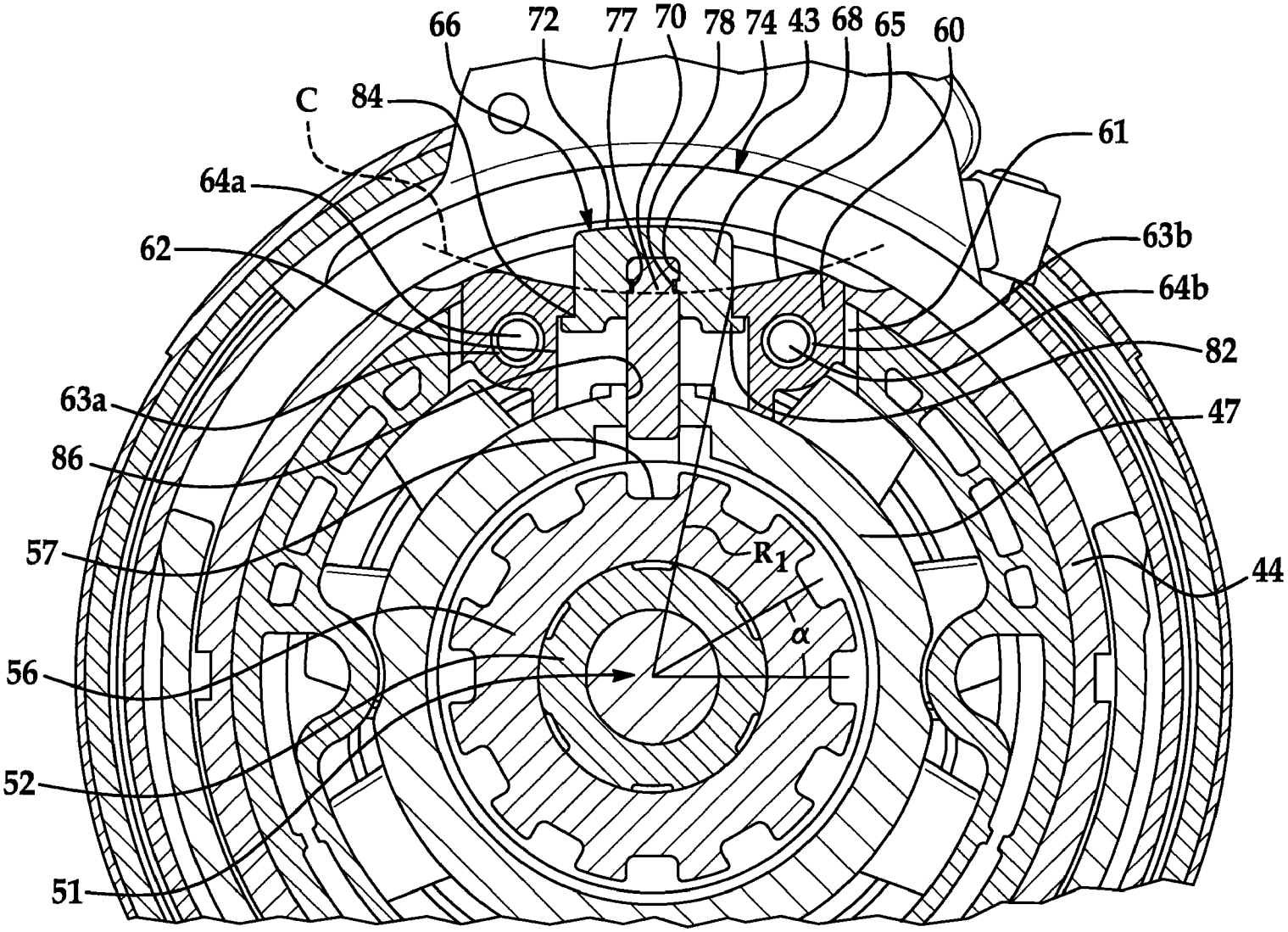
FIG. 3 is a sectional view of the power tool of FIG. 1 with the spindle lock assembly shown disengaged from the spindle.
Figure 4:
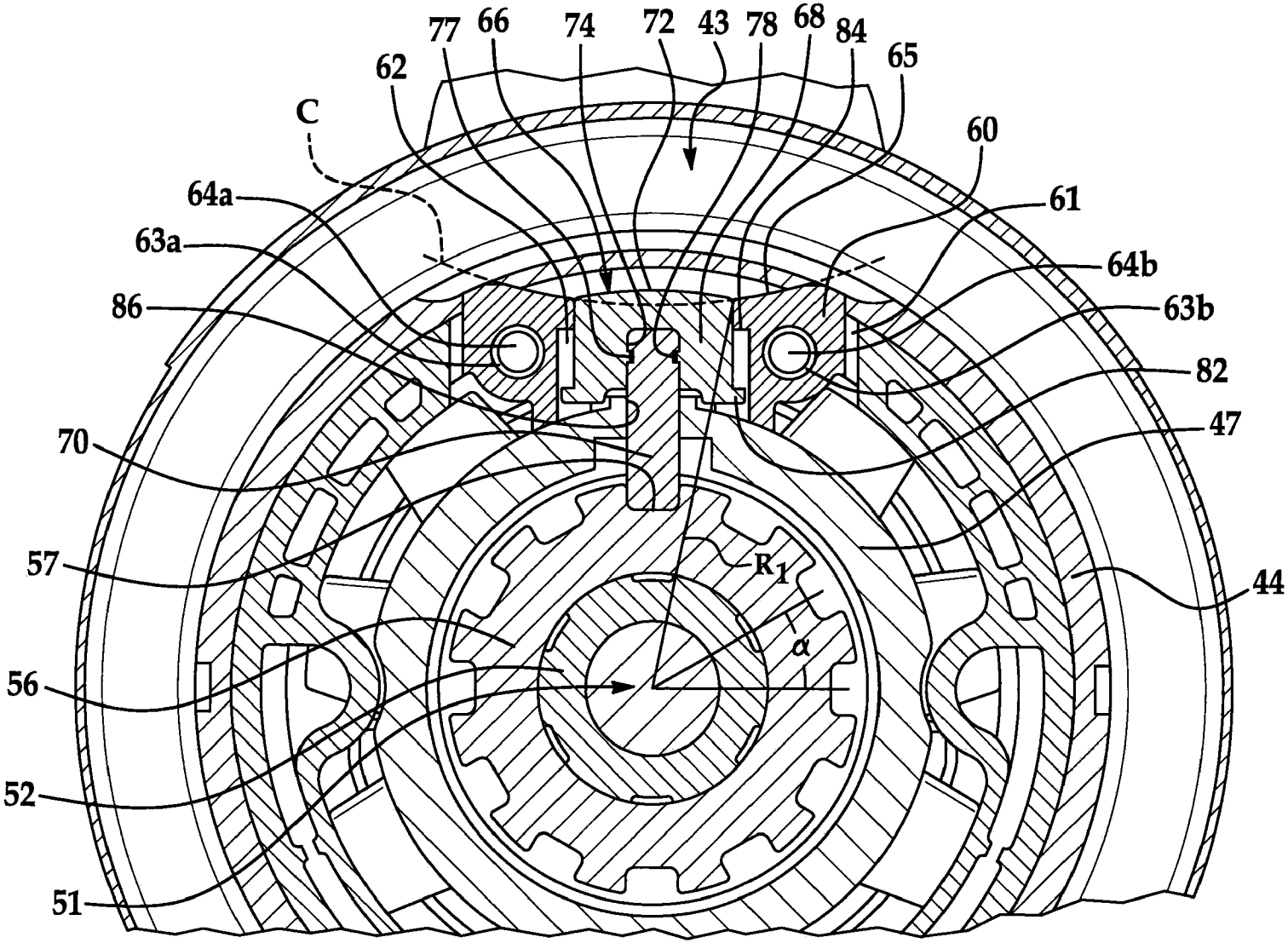
FIG. 4 is a sectional view of the power tool of FIG. 1 with the spindle lock assembly shown engaged with the spindle.

As best shown in FIGS. 3-5, the ring 56 includes a plurality of engagement members or detents 57. As shown in FIGS. 3 and 4, at least two of the detents 57 are disposed in spaced relationship less than 180 degrees, and preferably less than 90 degrees, from each other with respect to the axis X of the spindle assembly 15 (i.e., $\alpha<90°$). It will be appreciated that the spacing between the engagement members 57 is measured from a center of an engagement member to a center of another engagement member. In the embodiment shown, for instance, the ring 56 includes a plurality of detents 57 each extending in a radially inward direction partially into the ring 56 of the spindle assembly 15. However, it will be appreciated that the engagement members 57 could be of any suitable configuration. For instance, the ring 56 could have an outer surface with a plurality of flat sides, and the flat sides of the ring 56 could function as the engagement members 57 for the power tool 10. Also, in another embodiment, the engagement members 57 are formed directly on the shaft 52. In the preferred embodiment shown, the power tool 10 includes twelve engagement members 57 spaced approximately 30 degrees apart from each other (i.e., $\alpha=30°$) around the outer surface of the ring 56.

The spindle lock assembly 43, as shown in FIGS. 2, 3 and 4, includes a mount 60. The mount 60 is received in an opening 61 defined in the outer wall 44 of the motor housing 12. A back surface of the mount 60 abuts against the inner wall 47 of the motor housing 12. The mount 60 defines a central aperture 62. The mount 60 also includes attachment apertures 63*a*, 63*b* (FIGS. 3 and 4) on either side of the central aperture 62. The axis of the central aperture 62 extends horizontally and transversely to the axis X, and the axes of the attachment apertures 63*a*, 63*b* extend vertically, substantially parallel to the axis X. Fasteners 64*a*, 64*b* extend through the bottom wall 45 of the motor housing 12 and into corresponding ones of the attachment apertures 63*a*, 63*b* to thereby removably couple the mount 60 to the motor housing 12. It will be appreciated that the mount 60 could be fixedly coupled and/or integrally attached to the motor housing 12 without departing from the scope of the present disclosure.

As shown in FIGS. 3 and 4, an outer surface 65 of the mount 60 can be concave and contoured inward generally toward the axis and toward the spindle assembly 15 as represented by contour line C in FIGS. 3 and 4. As will be described in greater detail below, the concave curvature of the mount 60 ergonomically improves the spindle lock assembly 43.

The spindle lock assembly 43 further includes a button member 66. The button member 66 is moveably disposed in the center aperture 62 of the mount 60. The button member 66 includes a cap 68 and a pin 70. In one embodiment, the cap 68 is made of a polymeric material, and the pin 70 is made out of a metallic material.

As best shown in FIGS. 3 and 4, the cap 68 can include an outer surface 72 that is convex and curved outward generally away from the axis and the spindle assembly 15. The cap 68 also includes a first aperture 74 and a second aperture 76 on an interior surface thereof. The pin 70 is received within the first aperture 74. In one embodiment, the pin 70 is insert molded with the cap 68 so as to fixedly couple the pin 70 and the cap 68. Also, in one embodiment, the cap 68 includes a flange 77, and the pin 70 includes a corresponding groove 78 that receives the flange 77 for securely and fixedly coupling the cap 68 and the pin 70. It will be appreciated that the pin 70 could include the flange 77, and the cap 68 could include the groove 78 without departing from the scope of the present disclosure.

The second aperture 76 (FIG. 2) receives one end of a biasing member 80. In one embodiment, the biasing member 80 is a compression spring; however, it will be appreciated that the biasing member 80 could be of any suitable type. Also, in one embodiment, the cap 68 includes a retainer post 81 positioned within the second aperture 76. The end of the biasing member 80 fits on and around the retaining post 81 to thereby retain the biasing member 80 in position relative to the cap 68. An opposite end of the biasing member is supported against the inner wall 47 of the motor housing 12. Thus, the biasing member 80 biases against the inner wall 47 and the inner surface of the cap 68 so as to bias the cap 68 in the radially outward direction relative to the axis X.

Furthermore, as shown in FIGS. 3 and 4, the cap 68 includes a button flange 82 that extends outwardly from the cap 68, and the mount 60 includes a corresponding mount flange 84 that extends inwardly toward the cap 68. As shown in FIG. 3, the button flange 82 and the mount flange 84 can abut each other to thereby limit movement of the button member 66 relative to the mount 60 in a direction out of the motor housing 12. More specifically, the biasing member 80 biases the button member 66 radially outward, and the mount flange 84 interferes with the button flange 82 to limit the outward movement of the button member 66 away from the axis X.

Also, as shown in FIG. 4, depression of the button member 66 into the housing 12 toward the axis X is limited by abutment between the inner surface of the cap 68 and the inner wall 47 of the housing 12. Also, at a maximum displacement of the button member 66 relative to the mount 60 toward the axis X, the minimum radial distance R1 from the axis X to the outer surface 72 of the cap 68 is, at least, equal to the minimum radial distance R1 from the axis X to the outer surface 65 of the mount 60. Thus, in the embodiment shown in FIG. 4, the periphery of the outer surface 72 of the cap 68 is substantially flush with the outer surface 65 of the mount 60 at a maximum displacement of the button member 66 relative to the mount 60 toward the axis X as represented by the line of contour C. Other areas of the outer surface 72 of the cap 68 are outboard of the line of contour C of the outer surface 65 due to the convex curvature of the outer surface 72. It will be appreciated that the outer surface 72 of the cap 68 could be configured such that the entire outer surface 72 remains outboard of the outer surface 65 of the mount 60 at the maximum displacement of the button member 66 toward the axis X. As such, the ergonomics of the spindle lock assembly 43 are improved because the user's skin is unlikely to be pinched or trapped between button member 66 and the mount 60 when pressing the button member 66. Also, if the outer surfaces 72, 65 are substantially flush when pressing the button member 66, the user's finger can be supported by both the outer surface 72 of the cap 68 and the outer surface 65 of the mount 60 while holding the button member 66 in the lock position, for increased comfort.

Furthermore, as shown in FIGS. 2-4, the inner wall 47 of the housing 12 includes a pin aperture 86. The pin 70 is supported for sliding movement in the pin aperture 86. As shown in FIGS. 2 and 3, when the button member 66 is biased outward away from the axis X, the pin 70 remains inside the pin aperture 86 to maintain proper alignment. Also, as the button member 66 is depressed toward the spindle assembly 15, the pin 70 slides within the pin aperture 86 toward the spindle assembly 15.

The function of the spindle lock assembly 43 will now be described in greater detail. As shown in FIGS. 2 and 3, the button member 66 is biased radially outwardly away from the axis X by the biasing member 80. In this position, the pin 70 is disposed in spaced relationship from the spindle assembly 15, and in particular, from the engagement members 57 to allow the spindle assembly 15 to rotate freely about the axis X. In order to lock the spindle assembly 15 against rotation about the axis X, a user depresses the button member 66 against the biasing force of the biasing member 80. This causes the pin 70 to slide within the pin aperture 86 toward the spindle assembly 15. Once one of the engagement members 57 is aligned with the pin 70, the pin 70 enters the aligned engagement member 57 and selectively engages and locks the spindle assembly 15 against rotation about the axis X.

It will be appreciated that because there are a plurality of engagement members 57 spaced a relatively small angular distance, $\alpha$, away from each other about the axis X, the pin 70 is able to enter one of the engagement members 57 with relatively little rotation of the spindle assembly 15 before the pin 70 aligns with one of the engagement members 57. In other words, minimal rotation of the spindle assembly 15 is necessary before the pin 70 aligns with one of the engagement members 57 to engage and lock the spindle assembly 15. Accordingly, it becomes easier and less awkward to lock the spindle assembly 15 against rotation.

Furthermore, when rotating the collet nut 50 relative to the spindle assembly 15, a separate tool (e.g., a wrench) can be used. The plurality of closely spaced engagement members 57 allows the user to loosen or tighten the collet nut 50 in a ratcheting-type movement. More specifically, the user can couple the wrench to the collet nut 50, lock the spindle assembly 15 with the spindle lock assembly 43, and begin rotating the collet nut 50 relative to the spindle assembly 15. Then, once the collet nut 50 has been rotated through a desired angle, the user can release the button member 66 to release the spindle assembly 15, rotate the wrench backward to its original angular position, relock the spindle assembly 15 with the spindle lock assembly 43, and again rotate the collet nut 50 through a desired angle. This process can be repeated until the collet nut 50 is sufficiently rotated relative to the spindle assembly 15. Thus, the wrench can remain attached to the collet nut 50, and the wrench can remain in a desired zone of angular movement during this process for added convenience. This represents a very convenient method for loosening and tightening the collet nut 50.

Moreover, as described above, the spindle lock assembly 43 includes surfaces and other features that enhance the ergonomics of the spindle lock assembly 43. Thus, the spindle lock assembly 43 is more comfortable to use. Also, the motor housing 12 can be grasped while actuating the button member 66 with one hand while loosening or tightening the collet nut 50 with the other hand.

The foregoing discussion discloses and describes merely exemplary embodiments of the present disclosure. One skilled in the art will readily recognize from such discussion, and from the accompanying drawings and claims, that various changes, modifications and variations may be made therein without departing from the spirit and scope of the disclosure as defined in the following claims.

What is claimed is:

1. A power tool comprising:

a housing substantially housing a motor-driven spindle assembly supported for rotation about an axis, said spindle assembly including an output spindle having a coupling for releasably securing a tool bit thereto, said spindle assembly further including a plurality of engagement members, at least two engagement members disposed in spaced relationship less than one hundred eighty degrees from each other with respect to the axis of the spindle assembly, the plurality of engagement members comprising a plurality of detents each extending in a radial direction toward the axis and a spindle lock assembly that selectively engages at least one of the plurality of engagement members to lock the spindle assembly against rotation about the axis, the spindle lock assembly including a pin that selectively moves into one of the plurality of detents to lock the spindle assembly against rotation about the axis;

wherein the spindle lock assembly includes a button member and a mount, the mount being coupled to the housing, and the button member being movable relative to the mount in a radial direction to cause the pin to move into one of the plurality of detents to lock the spindle assembly against rotation about the axis; and further wherein the button member includes an outer surface that is surrounded by an outer surface of the mount, and at a maximum displacement of the button member relative to the mount toward the axis when the pin is engaged with one of said plurality of detents, the outer surface of the button is substantially flush with the outer surface of the mount.

2. The power tool of claim 1, wherein the mount includes an outer surface that has a concave curvature so as to be contoured inward generally toward the axis.

3. The power tool of claim 1, wherein the button member includes an outer surface that has a convex curvature so as to be contoured outwardly generally away from the axis.

4. The power tool of claim 1, wherein the housing defines an opening into which the spindle lock assembly is disposed, and further comprising at least one fastener that removably couples the mount to the housing.

5. The power tool of claim 1, wherein the housing includes an outer wall and an inner wall, wherein the outer wall includes an opening in which the spindle lock assembly is disposed, wherein the inner wall includes a pin aperture, wherein the button member includes a cap and a pin, and wherein the pin moves in the pin aperture to selectively engage the at least one of the plurality of engagement members to lock the spindle assembly against rotation about the axis.

6. The power tool of claim 5, wherein one of the cap and the pin includes a flange and the other of the cap and the pin includes a groove that receives the flange to thereby fixedly couple the cap and the pin.

7. The power tool of claim 1, wherein the housing includes an outer wall and an inner wall, wherein the outer wall includes an opening in which the spindle lock assembly is disposed, wherein the button member includes a biasing member and a cap, wherein the biasing member biases against the inner wall of the housing and the cap so as to bias the cap away from the axis.

8. The power tool of claim 7, wherein the cap includes a retainer that retains the biasing member relative to the cap.

9. The power tool of claim 1, wherein the button member includes a button flange and the mount includes a corresponding mount flange, wherein the button flange and the mount flange abut each other to thereby limit movement of the button member relative to the mount in a direction away from the axis.

10. The power tool of claim 1, wherein the power tool is a router, and wherein the spindle assembly removably couples to a collet nut for coupling a router bit to the spindle assembly.

11. The power tool of claim 1, wherein the spindle assembly includes a shaft and a ring that includes the engagement members, wherein the ring is fixedly coupled to the shaft.

12. A router comprising:

a housing;

a spindle assembly at least partially housed by the housing, the spindle assembly supported for rotation about an axis, the spindle assembly including an output spindle having a coupling for releasably securing a tool bit thereto and a plurality of detents each extending in a radial direction toward the axis, at least two detents disposed in spaced relationship less than one hundred eighty degrees from each other with respect to the axis of the spindle assembly; and a spindle lock assembly including a button member, a mount, and a biasing member that biases the button member away from the axis, the button member including a cap with an outer surface and a pin, the mount coupled to the housing and including an outer surface that is concavely contoured generally toward the axis, the button member supported for movement relative to the mount in a radial direction toward the axis to cause the pin to selectively engage at least one of the plurality of detents to lock the spindle assembly against rotation about the axis, wherein the outer surface of the cap is surrounded by the outer surface of the mount, wherein the outer surface of the mount is disposed at least at a first minimum radial distance from the axis, and at a maximum displacement of the cap relative to the mount toward the axis, a radial distance from the axis to the outer surface of the button member is at least approximately equal to the first minimum radial distance.

13. For a router having a motor-driven spindle assembly and a collet nut threadably coupled to an output spindle of the spindle assembly for releasably securing a tool bit to the output spindle, a method of rotating the collet nut relative to the spindle assembly, the method comprising:

locking the spindle assembly against rotation about an axis with a spindle lock assembly, the spindle assembly including a plurality of engagement members, at least two engagement members disposed in spaced relationship less than one hundred eighty degrees from each other with respect to the axis, wherein locking the spindle assembly includes selectively engaging at least one of the plurality of engagement members to lock the spindle assembly against rotation about the axis;

operatively coupling a removal tool to the collet nut;

rotating the removal tool within a predetermined zone of rotation less than one hundred eighty degrees about the axis in a first direction to rotate the collet nut with respect to the spindle assembly;

releasing engagement between the spindle lock assembly and the spindle assembly;

without decoupling the removal tool from the collet nut, rotating the removal tool, the collet nut, and the spindle assembly within the predetermined zone of rotation about the axis in a direction opposite to the first direction;

re-locking the spindle assembly against rotation about the axis with the spindle lock assembly by engaging the spindle lock assembly with another of the engagement members; and without decoupling the removal tool from the collet nut, rotating the removal tool within the predetermined zone of rotation about the axis in the first direction to further rotate the collet nut with respect to the spindle assembly.

14. The method of claim 13, wherein the plurality of engagement members are disposed in spaced relationship less than 90° from each other.

15. The method of claim 14, wherein the removal tool is a wrench.

* * * * *